US005992106A

United States Patent [19]

Carling et al.

[11] Patent Number: 5,992,106

[45] **Date of Patent: *Nov. 30, 1999**

[54] HEXAGON TILE WITH EQUILATERAL REINFORCEMENT

[75] Inventors: Jason D. Carling, West Jordan; Brad Andes, Bountiful; Frank A. Jugler, West Valley City; Jeffrey L. Nish, Centerville, all of Utah

[73] Assignee: Sport Court, Inc., Salt Lake City, Utah

[ * ] Notice: This patent is subject to a terminal disclaimer.

[21] Appl. No.: 09/128,123

[22] Filed: Aug. 3, 1998

Related U.S. Application Data

[63] Continuation-in-part of application No. 08/531,926, Sep. 21, 1995, Pat. No. 5,787,654.

[51] Int. Cl.[6] ..... E04F 15/16

[52] U.S. Cl. ..... 52/177; 52/180; 52/302.3; 52/403.1; 52/506.01; 52/588.1; 52/591.1; 52/747.1

[58] Field of Search ..... 52/81.4, 81.5, 52/126.5, 126.6, 177, 180, 220.5, 302.3, 390, 403.1, 506.01, 581, 588.1, 591.1, 591.2, 650.3, 663, 747.1, 747.11; 403/364, 393, DIG. 10

[56] References Cited

U.S. PATENT DOCUMENTS

| | | | |
|---|---|---|---|
| D. 233,832 | 12/1974 | Becker . | |
| D. 238,065 | 12/1975 | Harvey . | |
| D. 255,744 | 7/1980 | Dekko . | |
| D. 274,948 | 7/1984 | Swanson et al. . | |
| D. 327,748 | 7/1992 | Dorfman . | |
| 3,723,233 | 3/1973 | Bourke et al. . | |
| 3,909,996 | 10/1975 | Ettlinger, Jr. et al. . | |
| 4,436,779 | 3/1984 | Menconi et al. . | |
| 4,478,901 | 10/1984 | Dickens et al. . | |
| 4,584,221 | 4/1986 | Kung . | |
| 4,590,731 | 5/1986 | Degooyer . | |
| 5,379,557 | 1/1995 | Kotter . | |
| 5,628,160 | 5/1997 | Kung | 52/177 X |
| 5,787,654 | 8/1998 | Drost | 52/177 |
| 5,865,007 | 2/1999 | Bowman et al. | 52/177 X |

*Primary Examiner*—Carl D. Friedman
*Assistant Examiner*—Timothy B. Kang
*Attorney, Agent, or Firm*—Thorpe, North & Western

[57] ABSTRACT

A polymer tile for forming a floor covering, comprising a perimeter wall for providing support and for enclosing a perimeter boundary for the tile. A honeycomb configuration of intermediate wall structure is interconnected between inner portions of the perimeter wall and forms recurring hexagon units of hexagon support walls of common dimension, wherein the hexagon support walls have a height common with a height of the perimeter wall for providing support for a load imposed at a top surface of the tile within an intermediate area. A plurality of ribs of lesser height than the hexagon support walls are disposed in traversing orientation between opposing vertices of the hexagon support walls, and are joined at a central axis of the hexagon units as a common load transfer point to form a tile grid defining a plurality of hexagon support walls reinforced by equilateral triangles of lesser height formed within the hexagon units of the tile.

19 Claims, 4 Drawing Sheets

HEXAGON TILE WITH EQUILATERAL REINFORCEMENT

This is a continuation in part of Ser. No 08/531,926, filed on Sep. 21, 1995 now U.S. Pat No. 5,787,654.

BACKGROUND OF THE INVENTION

The present invention relates to a tile for use in modular flooring assemblies such as those used for athletic play areas. More particularly, the present invention is related to a modular flooring assembly which improves the dispersion of forces applied to the floor in order to prevent deformation and reduce wear on the flooring assembly.

Numerous types of flooring have been used to create playing areas for such sports as basketball and tennis, as well as for other purposes. These flooring assemblies include concrete, asphalt, wood and other materials which have varying characteristics. For each type of flooring, there are corresponding advantages and disadvantages. For example, concrete flooring is easy to construct and provides long term wear. However, the concrete provides no "give" during use and many people are injured each year during sporting events due to falls and other mishaps. Wood floors, such as are used for many basketball courts, have an appropriate amount of give to avoid such injuries. The wood floors, however, are expensive to instal and require continued maintenance to keep them in good condition.

Due to these concerns, the use of modular flooring assemblies made of synthetic materials has grown in popularity. The synthetic floors are advantageous for several reasons. A first reason for the flooring assemblies' popularity is that they are typically formed of materials which are generally inexpensive and lightweight. If a tile is damaged it may easily be replaced. If the flooring needs to be temporarily removed, the individual tiles making up the floor can easily be detached, relocated, and then reattached to form a new floor in another location. Examples of modular flooring assemblies include U.S. Pat. No. Des. 274,588; U.S. Pat. No. 3,438,312; U.S. Pat. No. 3,909,996; U.S. Pat. No. 4,436,799; U.S. Pat. No. 4,008,548; U.S. Pat. No. 4,167,599; U.S. Pat. No. 4,226,064 and U.S. Pat. No. Des. 255,744.

A second reason for the popularity of the flooring assemblies is that the durable plastics from which they are formed are long lasting. Unlike other long lasting alternatives, such as asphalt and concrete, the material is generally better at absorbing impacts, and there is less risk of injury if a person falls on the plastic material, as opposed to concrete or asphalt. The connections for the modular flooring assembly can even be specially engineered to absorb lateral force to avoid injuries, as is described in U.S. Pat. No. 4,930,286. Additionally, the flooring assemblies generally require little maintenance as compared to other flooring, such as wood.

One problem which has plagued the modular floor covering assemblies is that of uneven load distribution. Uneven load distribution can make the floor feel unnatural to those using it, and can result in premature failure of the flooring tiles. Both of these problems have limited the use of the modular flooring systems. If the floor feels unnatural, those using the facility will often object to the flooring tiles and/or return to more conventional floor materials, such as a wood or concrete. Likewise, premature failure of the flooring tiles also increases the likelihood that the modular flooring will be replaced by other alternatives.

Attempts to create improved flooring assemblies have lead to numerous different designs. U.S. Pat. No. 5,787,654 disclosed one such improvement in the form of an "isogrid" tile having equilateral sides in triangular configuration. While such flooring assemblies offer a significant improvement in load distribution and enhanced tile performance, a substantial cost is involved with the quantity of material needed for the equilateral wall structure of an isogrid tile. Thus, there is needed an improved tile which has a configuration suited to develop the even distribution of load and impact forces, but providing economy in cost.

In addition to the need for improved tiles which more evenly distribute load, there is also a need for an improved tile which decreases the risk of warping and other distortions, while at the same time reducing the amount of plastic material to meet tile specifications.

OBJECTS AND SUMMARY OF THE INVENTION

Thus, it is an object of the present invention to provide a tile with near equivalent strength and loading capacity as the isogrid tile, but with less cost and complexity in manufacture.

It is yet another object of the invention to provide a modular flooring assembly which includes numerous tiles connected to one another to form a floor for sporting events which evenly distributes load placed on the modular flooring assembly.

The above and other objects of the invention are realized in specific illustrated embodiments of a hexagon tile comprised of a honeycomb configuration of supporting wall structure forming recurring hexagon units. Each hexagon unit includes a plurality of parallel ribs disposed in traversing orientation between opposing vertices of the hexagon unit and being joined at a central axis of the hexagon unit as a common load transfer point to form a grid defining a plurality of equilateral triangles within the hexagon units of the tile.

In accordance with another aspect of the invention, the tile includes a perimeter support wall defining an outer boundary of the tile and including interconnecting structure for releasably connecting with interconnecting structure of adjacent tiles to form a continuous floor surface. An intermediate grid structure is internally coupled to the perimeter support wall and within the outer boundary. The grid structure comprises hexagon units having at least two differing cross-sectional geometries taken in two different planes parallel to a top surface of the tile, including:

(i) a first planar cross-section comprising a repeating pattern of equilateral triangles extending substantially across an entire area of the first planar cross-section and being located at an upper portion of the tile; and (ii) a second planar cross-section comprising a repeating pattern of hexagonal polygons extending in parallel orientation substantially across an entire area of the second planar cross-section of the same tile.

In accordance with still another aspect of the invention, a flat surface layer is attached to an upper end of the ribs so as to provide a generally planar floor surface, while providing the improved load dispersion of the equilateral triangles discussed above.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the appended claims.

Figure 1:
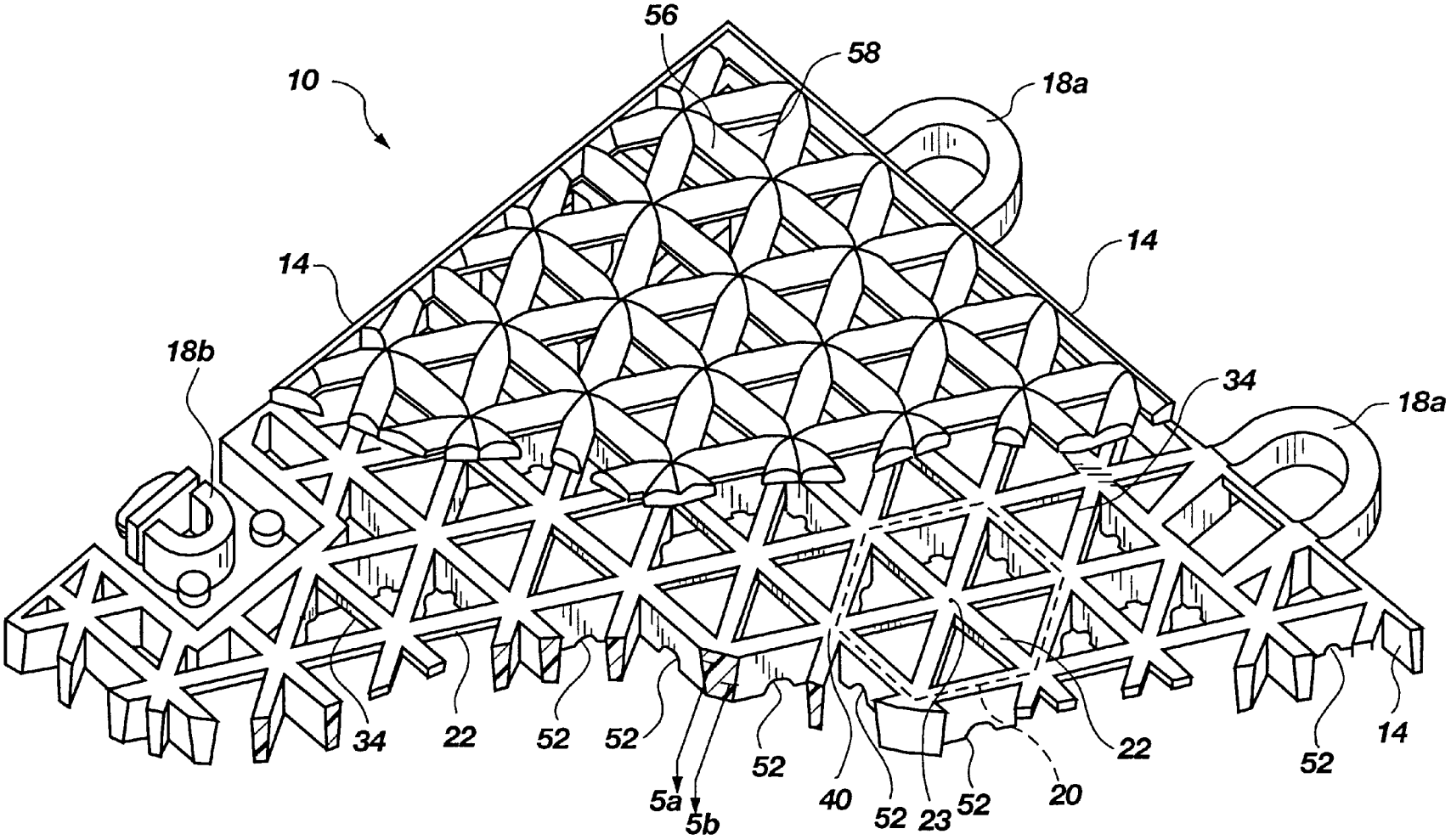
FIG. 1 shows a partial, fragmented, elevational perspective view of a flooring tile having a contoured tread surface subsupport structure with a hexagon grid configuration formed in accordance with one embodiment of the present invention.
Figure 2:
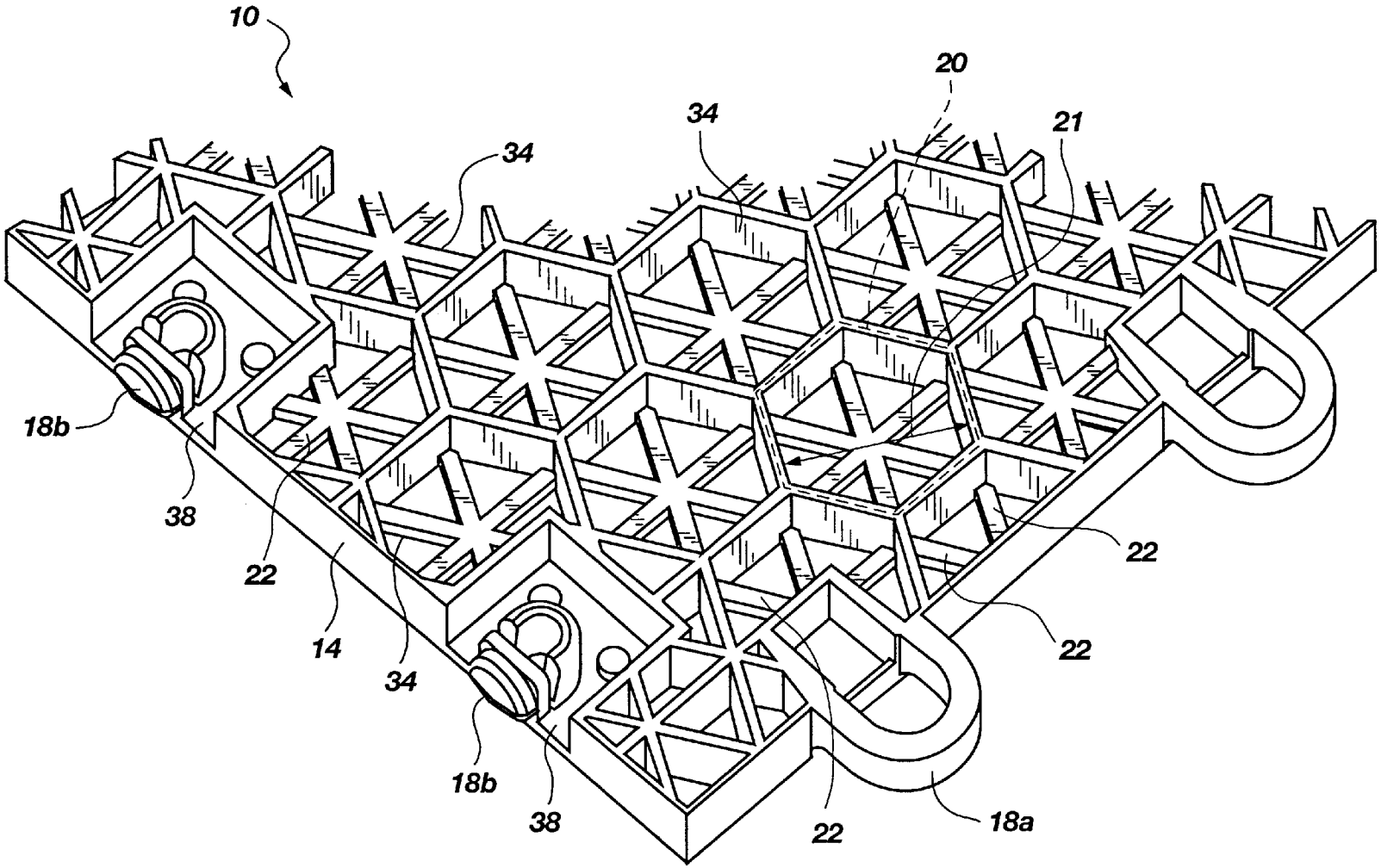
FIG. 2 illustrates a bottom, perspective view of the hexagon support grid, including interlocking loop and insert structure for joining multiple tiles.

Referring to FIG. 1, there is shown a top perspective view of a portion of a flooring tile, generally indicated at 10, made in accordance with the principles of the present invention. The flooring tile 10 has an outer perimeter which is defined by a wall 14. A pair of interlocking attachments, typically a positioning loop 18*a* and a resilient insert 18*b* which nests in the positioning loop, are formed in respective sides of the wall so as to nest with a loop or insert from an additional tile which would be positioned adjacent the tile 10 in FIG. 1. The positioning loop 18*a* and the insert 18*b* are disposed on the flooring tile 10 to enable a plurality of tiles to be joined together in a single floor assembly, such as a tennis court or basketball court.

While many attachment devices have been taught in the prior art, the specific positioning loop 18*a* and the resilient insert 18*b* shown are preferred because they allow lateral give between the tiles. The lateral give allows for improved absorption of sudden forces, such as those which are common to games like basketball and tennis which involve sudden acceleration and deceleration. A preferred embodiment of the attachment devices is explained in detail in U.S. Pat. No. 4,930,286 which is expressly incorporated herein.

Disposed inside the exterior wall 14 are repeating groups of polygon support structure having a hexagon shaped perimeter wall. This pattern is identified by dashed line 20. It will be noted that each side of the hexagon defines a common side with an adjacent hexagon unit in recurring pattern. The dimensions of the hexagon units are best defined by the diagonal lengths 21 which traverse between opposing parallel side walls of the hexagon. Typically, this length will range between 0.3 to 1.0 inches, and is preferably 0.5 to 0.7 inches. The embodiments illustrated in the figures have been enlarged for detail. Actual tiles have been constructed with a hexagon cell diameter of 0.625 inches, with a height of approximately 0.5 inches.

Figures 3, 3A:
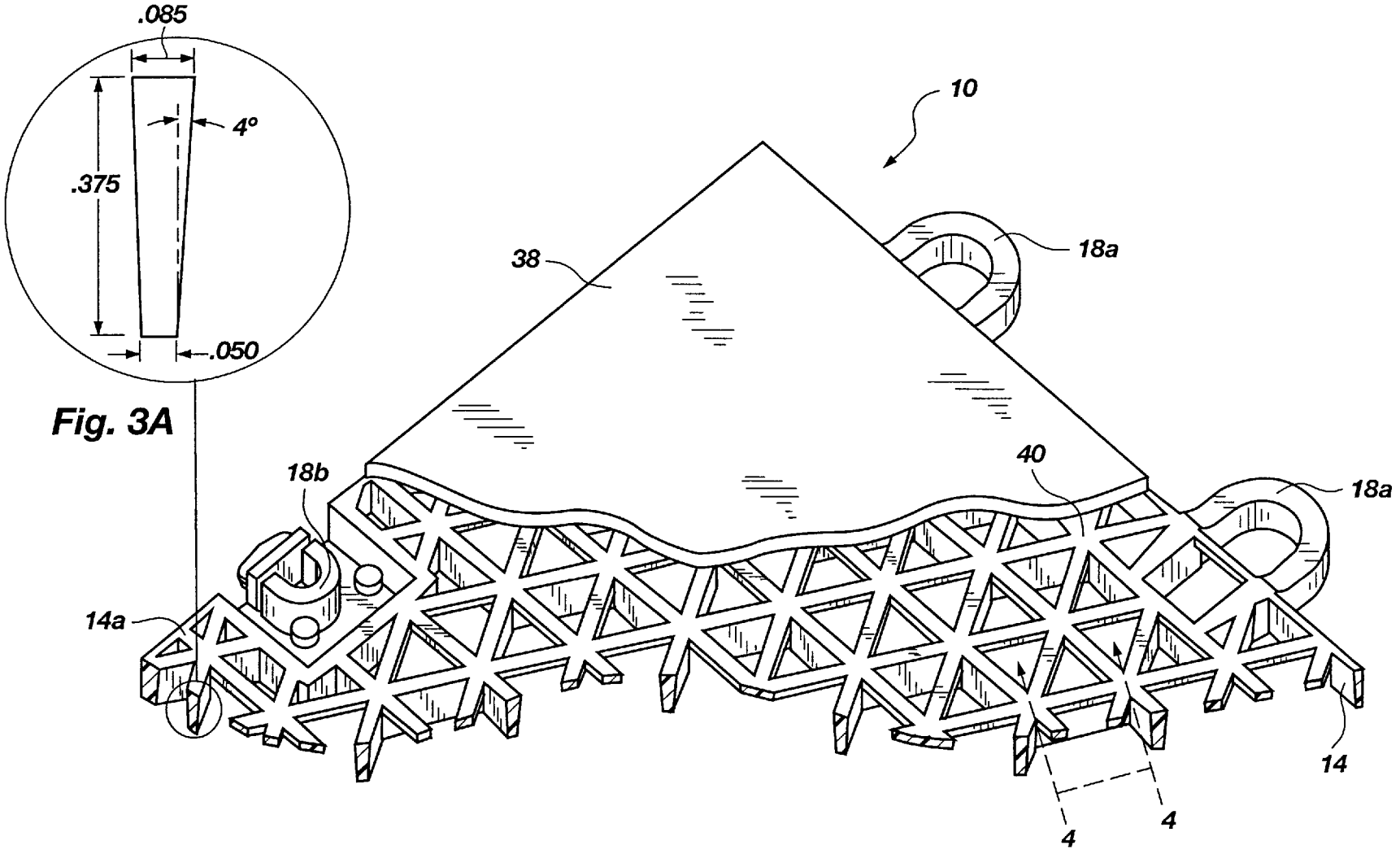
FIG. 3 shows a cut-away view of the flooring tile with a flat surface layer disposed thereon in accordance with one aspect of the invention.
FIG. 3A is a detailed side view of a wall in accordance with one aspect of the present invention.

As shown in FIG. 1, the hexagon support structure includes a plurality of elongate ribs 22 disposed across the diagonal of the polygon to form contiguous equilateral triangles having a common axis 23 at the central axis of the hexagon perimeter. These cross ribs provide reinforcing support similar to the equilateral ribs of the referenced isogrid tile of the parent application. Dimensions range from 0.10 to 0.30 inches in cross-section width and 0.03 to 0.30 inches in height. Preferred height and width are 0.05 inches and 0.075 inches respectively when applied to a tile having a full plate tread surface as shown in FIG. 3.

Typical tile dimensions and composition will depend upon the specific application to the tile will be applied. Sport uses, for example, generally require tiles having a square configuration with a side dimension of either 9.8425 inches (metric tile) or 12.00 inches. Compositions are usually of an olefin polymer such as polypropylene or polyethylene. Those skilled in the art will appreciate other variations in size and composition that may be implemented within the parameters of the present invention.

It has been discovered that a surprising retention of stiffness and strength occurs with removal of the lower portion of wall structure of the isogrid ribs which form diagonals of the hexagon configuration. This modification of the previous isogrid tile is readily accomplished in the mold process by simply reducing the tool cavity corresponding to the cross-rib portion of the mold. Not only is there an unexpected increase of strength and stiffness with a significant reduction in polymer material, but mold costs are reduced and production efficiency is substantially enhanced. Mold release is particularly improved because of the significant decrease in surface area and cavity volume.

Formation of these cross ribs 22 maintains the plurality of equilateral triangles as shown in the figures. In accordance with the invention previously disclosed in the parent patent, it has been found that the equilateral triangles 34 formed by the intersecting elongate ribs provide an improved mechanism for distributing load in the tile 10, and therefore over an entire flooring assembly. This is especially true for rolling and point loads. The plurality of equilateral triangles 34 better distribute the load, and reduce the risk of damage when heavy loads are rolled over the tile 10. By maintaining the hexagon diameter at less than one inch, and by adjusting the height of the cross ribs based on the nature of anticipated load, adequate force distribution is maintained. Lesser lengths in diameter allow substantial reductions in rib height, giving the attendant benefit of mold release and reduction of plastic material.

Top wear or tread surface structure may be selected from a variety of well known configurations. FIG. 1 shows a contoured surface 56 suitable for outdoor use and sport playing surfaces. The contoured surface provides a measure of comfort for persons without shoes and for protection when players fall and slide along or otherwise contact the surface. The open grid structure 58 at the top of the tile allows debris and water to readily pass through.

Figure 4:
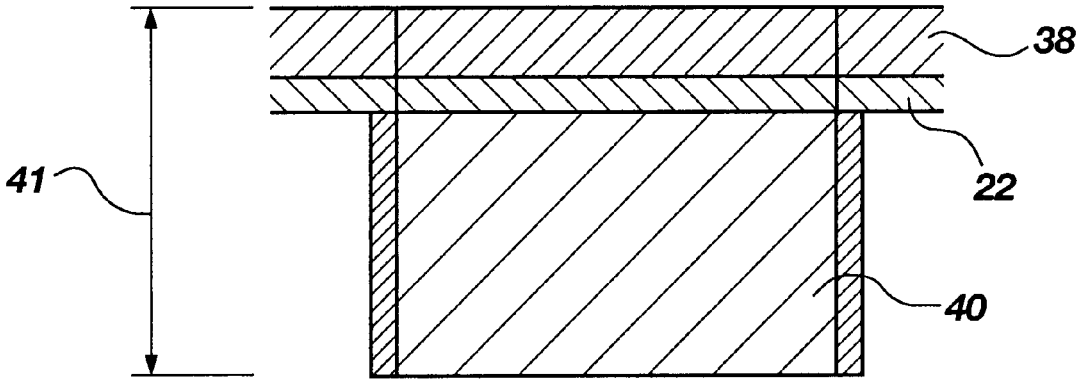
FIG. 4 depicts a cross-section taken along the lines 4—4 of FIG. 3.

FIG. 3 depicts a tread or wear surface formed of a plate or surface member 38. Those skilled in the art will appreciate that in certain applications, the user of the flooring tile 10 will desire a generally planar surface on which to stand or set items, or on which to conduct sporting activities. To accomplish this, a flat surface member 38—typically a synthetic, rubber-like material—is disposed on top of the hexagon support structure and cross ribs, and extends to a position adjacent to the wall 14 about the periphery of the tile 10. Other surface configurations will be apparent to those skilled in the art. Such surfacing provide additional stiffening thickness to the overall tile, and generally will have a thickness of approximately 0.05 to 0.1 inch. The plate embodiment of FIG. 3, for example, measures a thickness of 0.075 inches. As illustrated in FIG. 4, the total tile height 41 of 0.50 includes (i) the tread layer 38 of 0.075 inches, (ii) the rib 22 height of 0.05 inches, and (iii) lower hexagon support wall 40 at 0.375 inches.

Many prior art modular flooring assemblies have had considerable problems with deformation. One typical cause is the thermal expansion and contraction of materials placed on the tiles in order to form a generally contiguous surface. The thermal expansion and contraction typically leads to tiles which are warped or otherwise deformed.

To overcome these concerns, the flat surface member 38 will typically be mounted to the grid formed by the hexagon unit with interstitial equilateral triangle structure 34 and the wall 14 in a manner similar to that described in U.S. Pat. No. 4,930,286, which has been incorporated herein.

Referring now to FIG. 3, there is shown a close-up, fragmented view of the tile 10. Each of the hexagon walls has a thickness of about 0.05 inches at its base, and 0.085 inches the upper section which joins with the rib or tread portion. Rib thickness my be slightly larger. To facilitate mold release, a four degree draft (shown in FIG. 3A) from the bottom end of the hexagon wall is provided. In other words, support walls taper outwardly toward the top end at an angle of about four degrees. Such a draft is especially beneficial when the tiles are molded from a plastic material. The draft allows easy removal of the flooring tile 10 from a mold.

As was mentioned above, the equilateral triangle 34 grid improves the performance of the tile 10. Specifically, the triangles 34 improve the ability of the tile to disperse load without warping—especially heavy point loads and rolling loads. The load is dispersed by the respective ribs which are disposed in three different orientations which are evenly spaced from one another. This enables the tile 10 to perform better and last longer than conventional tiles.

Thus, there is disclosed an improved tile for flooring assemblies. The hexagon tile uses ribs forming a plurality of equilateral triangles to more evenly distribute load caused when using the floor. The combination of hexagon support structure with equilateral triangular grid also allows thinner tiles to be used while retaining the same overall mass as conventional tiles.

Figure 5A:
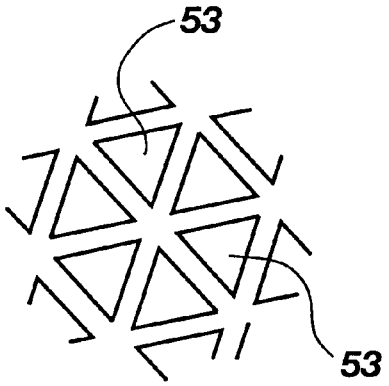
FIG. 5 is a geometric representation of planar intersection at an isolated hexagon unit, as identified by plane intersections 5*a* and 5*b*.
Figure 5B:
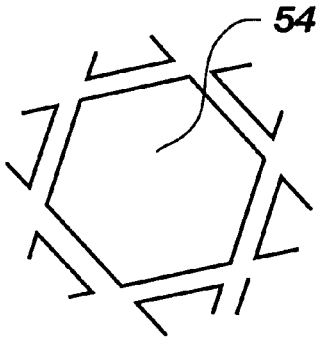

This combination of hexagon geometry with internal equilateral triangles can also be represented as in FIG. 5*a* and 5*b*, which show the intersection of two parallel planes (represented in location by the cross line at the tile wall and in orientation by the attached arrow 5*a* and 5*b*) at differing heights within the tile. The invention within the tile is characterized by a perimeter support wall 14 defining an outer boundary of the tile and including interconnecting structure 18*a* for releasably connecting with interconnecting structure 18*b* of adjacent tiles to form a continuous floor surface. The cross ribs 22 form intermediate grid structure which is internally coupled to the perimeter support wall and within the outer boundary. This grid structure provides hexagon units having at least two differing cross-sectional geometries taken in the two different planes represented by 5*a* and 5*b*. These planes are parallel to a top surface of the tile, and provide two intersecting planar geometries as follows:

(i) a first planar cross-section (FIG. 5*a*) comprising a repeating pattern of equilateral triangles 53 extending substantially across an entire area of the first planar cross-section and being located at an upper portion of the tile; and (ii) a second planar cross-section (FIG. 5*b*) comprising a repeating pattern of hexagonal polygons 54 extending in parallel orientation substantially across an entire area of the second planar cross-section of the same tile. It will be apparent to those skilled in the art that other forms of definition of the present invention may be possible.

An additional benefit of the hexagon tile is an enhanced acoustic response. Conventional plastic tiles are sometimes criticized because of a hollow, thin sound when impacted with player activity. This is in contrast to the solid, firm response of a hardwood floor. The new hexagon tile develops an acoustic response more closely related to the solid sound of the hardwood floor, and therefore will contribute to enhanced satisfaction by users.

Those skilled in the art will recognize numerous additional modifications which can be made without departing from the scope and spirit of the present invention. The appended claims are intended to cover such modifications.

What is claimed is:

1. A polymer tile for forming a floor covering, comprising:

a perimeter wall for providing support and for enclosing a perimeter boundary for the tile;

a honeycomb configuration of intermediate wall structure interconnected between inner portions of the perimeter wall and forming recurring hexagon units of hexagon support walls of common dimension, said hexagon support walls having a height common with a height of the perimeter wall for providing support for a load imposed at a top surface of the tile within an intermediate area; and a plurality of ribs of lesser height than the hexagon support walls and being disposed in traversing orientation between opposing vertices of the hexagon support walls, said ribs being joined at a central axis of the hexagon units as a common load transfer point to form a tile grid defining a plurality of hexagon support walls reinforced by equilateral triangles of lesser height formed within the hexagon units of the tile.

2. The tile of claim 1, wherein a majority of wall sections of the hexagon units form respective common walls with respective adjacent hexagon units within the tile.

3. The tile of claim 2, wherein the hexagon units and plurality of traversing ribs are disposed in a common plane.

4. The tile of claim 1, wherein opposing side walls of the hexagon units are spaced apart from one another between 0.3 to 1.0 inches.

5. The tile of claim 4, wherein the side walls are spaced apart at a distance between 0.5 and 0.7 inches.

6. The tile of claim 4, wherein the side walls are spaced apart and a distance of approximately 0.625 inches.

7. The tile of claim 1, wherein the interconnecting ribs traversing between the vertices of the hexagon units have a cross-section thickness within a range of 0.10 to 0.30 inches and a height between 0.03 to 0.30 inches.

8. The tile of claim 7, wherein the interconnecting ribs traversing between the vertices of the hexagon units have a cross-section thickness of approximately 0.075 inches and a height of approximately 0.05 inches.

9. The tile as defined in claim 1, further comprising interconnecting structure for releasably connecting with interconnecting structure of adjacent tiles to form a continuous floor surface.

10. A tile for forming a floor covering, comprising:

a perimeter support wall defining an outer boundary of the tile and including interconnecting structure for releasably connecting with interconnecting structure of adjacent tiles to form a continuous floor surface;

intermediate grid structure internally coupled to the perimeter support wall and within the outer boundary, said grid structure comprising hexagon units having at least two differing cross-sectional geometries taken in two different planes parallel to a top surface of the tile, including:

(i) a first planar cross-section comprising a repeating pattern of equilateral triangles extending substantially across an entire area of the first planar cross-section and being located at an upper portion of the tile; and (ii) a second planar cross-section comprising a repeating pattern of hexagonal polygons extending in parallel orientation substantially across an entire area of the second planar cross-section of the same tile.

11. The tile of claim 10, wherein a majority of wall sections of the hexagon units form respective common walls with respective adjacent hexagon units within the tile.

12. The tile of claim 11, wherein the hexagon units include a plurality of traversing ribs disposed in a common plane with the hexagonal units.

13. The tile of claim 10, wherein opposing side walls of the hexagon units are spaced apart from one another between 0.3 to 1.0 inches.

14. The tile of claim 13, wherein the side walls are spaced apart at a distance between 0.5 and 0.7 inches.

15. The tile of claim 14, wherein the side walls are spaced apart and a distance of approximately 0.625 inches.

16. The tile of claim 10, wherein the interconnecting ribs traversing between the vertices of the hexagon units have a cross-section thickness within a range of 0.10 to 0.30 inches and a height between 0.03 to 0.30 inches.

17. The tile of claim 16, wherein the interconnecting ribs traversing between the vertices of the hexagon units have a cross-section thickness of approximately 0.075 inches and a height of approximately 0.05 inches.

18. The tile as defined in claim 10, further comprising interconnecting structure for releasably connecting with interconnecting structure of adjacent tiles to form a continuous floor surface.

19. A method for uniformly dispersing load in a floor covering assembly, the method comprising:

(a) forming the floor covering from a plurality of tiles having intersecting ribs disposed so as to form a plurality of hexagonal support walls configured in honeycomb manner and including reinforcing cross rib structure disposed between vertices of the hexagonal support walls to form six equilateral triangles wherein the cross ribs have a lesser height than the hexagonal support walls; and b) placing a load on the tile.

* * * * *